United States Patent [19]

Schermerhorn et al.

[11] 4,101,810

[45] Jul. 18, 1978

[54] SYSTEM FOR AND METHOD OF OPERATING GAS DISCHARGE DISPLAY AND MEMORY

[75] Inventors: Jerry D. Schermerhorn, Swanton; John W. V. Miller, Toledo, both of Ohio

[73] Assignee: Owens-Illinois, Inc., Toledo, Ohio

[21] Appl. No.: 688,044

[22] Filed: May 19, 1976

[51] Int. Cl.[2] ..... H05B 41/14

[52] U.S. Cl. ..... 315/169 TV; 340/324 M

[58] Field of Search ..... 340/324 M; 315/169 TV

[56] References Cited

U.S. PATENT DOCUMENTS

| | | | |
|---|---|---|---|
| 3,803,449 | 4/1974 | Schmersal | 315/169 TV |
| 3,993,990 | 11/1976 | Miller et al. | 340/324 M |

*Primary Examiner*—Richard A. Farley

*Attorney, Agent, or Firm*—Donald K. Wedding; Myron E. Click; David H. Wilson

[57] ABSTRACT

Operating wave forms which are asymmetrical are applied to a gas discharge display and memory panel device to simplify the drive electronics, improve interfacing to logic controls and adapt to integrated circuitry. One bulk sustainer wave form is applied to one array of a pair of transversely oriented electrode arrays. Addressing wave forms for altering the discharge state of discharge sites between the arrays are superimposed on the bulk sustainer and thus referenced to the bulk sustainer voltage levels for electrodes of the one array. The other array has addressing wave forms which are referenced to a fixed voltage level, advantageously ground and are sequenced to function as a component of the composite sustainer wave form for the panel and discharge manipulating wave forms for selected discharge sites of the panel or the entire panel. A system affording the above operations is set forth together with addressing logic suitable for integrated circuit gating to the device electrodes. Typical wave forms are disclosed for write, erase and bulk erase functions.

39 Claims, 6 Drawing Figures

SYSTEM FOR AND METHOD OF OPERATING GAS DISCHARGE DISPLAY AND MEMORY

CROSS REFERENCE TO RELATED APPLICATIONS

This invention is related to subject matter of Miller et al. application Ser. No. 546,241, filed Feb. 3, 1975, which issued on Nov. 23 ,1976 as U.S. Pat. No. 3,993,990.

BACKGROUND OF THE INVENTION

1. Field of the Invention

This invention relates to multicelled gas discharge display/memory devices and more particularly to methods of operating such devices with preferred wave forms for addressing and sustaining functions which simplify the circuitry associated with the devices.

2. Description of the Prior Art

Multicelled gas discharge devices as display and/or memory units have been proposed in the form of a pair of opposed dielectric charge storage members which are backed by electrodes, the electrodes being arranged in a first and second array which are so oriented with respect to an ionizable gaseous medium as to define discharge sites in the gas between electrodes separated from the gas by dielectric. Commonly, the devices are arranged with the electrodes of the first and second arrays transversely related, either on opposite sides of a thin volume of the gaseous medium, as disclosed in Baker et al. U.S. Pat. No. 3,499,167 which issued Mar. 3, 1970, or on the same side of a volume of the gaseous medium, as by the presence of cavities in the dielectic between transverse electrodes embedded in the dielectric as disclosed in Schermerhorn U.S. Pat. No. 3,787,106 which issued Jan. 22, 1974. Charged particles (electrons and ions) produced upon ionization of the gas volume of a selected discharge site, when proper alternating operating voltages are applied across the gas and dielectric between opposed electodes, are collected upon the surface of the dielectric at specifically defined location and constitute an electrical field opposing the electrical field which created them. Those collected charges present a wall voltage on the dielectric which augments an applied voltage of the polarity opposite that which caused their collection so that the potential across the intervening gas is sufficient to again initiate a collection of charges on the dielectric walls. This repetitive and alternating charge collection and ionization discharge constitutes an electrical memory of a cell or site in the "on" state of discharge. With properly chosen values of the alternating voltage, cells or sites in the "off" state of discharge remain in that state during the alternations, hence that state is also retained in electrical memory.

The alternating voltage offering the above memory characteristics is termed a "sustaining voltage". For a given device it usually has a range of values. Current forms of panel devices typically operate with sustainer voltage transitions of about 95 volts on either side of a neutral level where a delectric overcoat of magnesium oxide is interfaced with the gaseous medium as disclosed in Hoehn et al., U.S. Pat. No. 3,863,089 which issued Jan. 28, 1975 and the gaseous medium is typically about 99.9 percent atoms neon and 0.1 percent atoms argon at a pressure of from 0.2 atmospheres to about 1 atmosphere and the discharge gap is of 4 to 6 mils.

Conventionally the sustainer voltage applied across a device has been made up of components applied to each electrode array as with switching circuits referenced to a common point, frequently ground. A fixed or variable period has been proposed for the sustainer. Addressing of selected discharge sites has been accomplished by augmenting voltage signals superimposed on and thus referenced to the pulsating voltages of the sustainer components. In Schmersal U.S. Pat. No. 3,803,449 which issued Apr. 9, 1974 there is disclosed a sustainer controlled system wherein the sustainer component to individual selected electrodes or groups of electrodes is imposed for a time duration which is selected in accordance with discharge manipulation desired at a site. Lengthening the time duration of and/or increasing the magnitude of the high voltage interval of the sustainer imposed across a site places it in an "on" state of discharge while shortening the time duration of the sustainer pulse causes an erase discharge at the selected site. In Miller et al. U.S. Patent application Ser. No. 546,241 filed Feb. 3, 1975, now U.S. Pat. No. 3,993,990, a system is disclosed in which the sustainer was modified by contracting the time duration of that portion of a sustainer period which was not employed in a discharge manipulating function while lengthening the time duration of that portion which was utilized in the manipulation. Such changes were concerned with extending the time duration of addressing pedestal levels of the sustainer and imposed addressing voltage pulses on those pedestals for both write and erase functions.

Schmersal acheived a simplification in electronics by eliminating addressing driver circuits for the electrodes however his constant amplitude pulse square wave sustainer required individual electrode controls for the sustainer components. He sought to simplify such controls by employing a multiplexing approach. Thus while a regular sustainer cycle was applied to those electrodes outside the region of discharge manipulation certain electrodes associated with the region were subjected to partial select signals which were outside the select write or erase voltage margins of their sits. The full signals were applied only to discharge sites desired to be addressed. In the Miller et al disclosure the system employed bulk sustainer voltage sources for each array of electrodes, logic control of the bulk sustainers according to the discharge manipulation to be performed, and individual or multiplexed electrode address drivers for the write and erase function operating from floating sustainer voltages.

Schermerhorn U.S. Pat. No. 3,851,210 granted Nov. 26, 1974 employed asymmetric sustainer voltage components to manipulate discharge states of sites in a display/memory panel device. Interchange of the sustainer asymmetry between electrode arrays effectively shifted the neutral wall charge of the sites sufficiently to invert their discharge states. Discharge manipulation of but one form could then be employed as an addressing technique since, for example, an erase function could be used to terminate discharges in the normal operation of the device or to initiate discharges by erasing a site while the device was in an inverted discharge state and then reinverting the device to place that site in an "on" state of discharge.

The present invention facilitates the manipulation of discharge state at selected discharge sites in a display/memory panel device.

Another object of the invention is to simplify the drive circuitry for display/memory panel devices.

A third object is to simplify the logic interfacing to the addressing drives for display/memory panel devices.

A forth object is to adapt display/memory panel device operation to integrated circuit drive electronics.

SUMMARY OF THE INVENTION

The above and other objects are realized in accordance with this invention by operating a gaseous discharge display/memory panel with a bulk sustainer voltage applied to but one electrode array and providing addressing circuit means for the electrodes of each array with the drivers of the electrode array cooperating with the one array also providing sustainer voltage signals to the bulk of those electrodes. In this arrangement the addressing circuit means for selectively applying select signals to individual electrodes of the first electrode array is referenced to the bulk sustainer voltage, however, the addressing circuit means for applying sustainer voltages to the second electrode array and for addressing individual electrodes of that array is referenced to a fixed voltage level, advantageously ground. This facilitates logic signal interfacing with the addressing circuit means for the second array and eliminates the need for a separate source of sustainer voltage for that array.

At the voltage levels illustrated the addressing circuits for each array of electrodes are coincidence gates which can be fabricated as integrated circuits functioning as positive logic ANDs for one array and positive logic NANDs for the other. Three signal input gates provide the control, one a strobe or enable signal, another a multiplex or group selection signal, and the third a line or electrode selection signal. Conversion from logic signal levels to panel drive levels can be accomplished within the gates of the ground referenced group and signals can be referenced from a bulk sustainer of varying voltage with a logic signal level shifter referenced to the bulk sustainer according to the logic requirements of the system.

The bulk sustainer signals and addressing signals are all subject to logic control. A three level sustainer waveform is shown. It is illustrated as a fifty kilohertz cyclic signal as applied to many control systems for gaseous discharge display/memory panels. Within its illustrative twenty microsecond period three voltage levels are shown, a high voltage $V_H$, typically 140 volts, a medium voltage $V_M$, typically 40 volts, and a low voltage $V_L$, typically 0 volts In a writing function, the transfer of an "off" site to an "on" state of discharge, the time duration of a high voltage initiated at $V_H$ is relatively long, such as $\frac{5}{8}$ of a period with the balance of the period at the low voltage $V_L$. In an erase function, the higher voltage portion is shortened, as to $\frac{3}{8}$ of a period with a lower voltage portion, $\frac{5}{8}$ of the period, comprised of $\frac{1}{4}$ of a period of low voltage $V_L$ followed by $\frac{3}{8}$ of a period of the medium voltage $V_M$. The sustainer voltage imposed on the second electrode array by the addressing drivers for that array is applied in bulk to those electrodes by operating all such drivers with the pulse voltage, 50 volts in the example, applied for a write function one quarter of a period after initiation of high voltage of the bulk sustainer and maintained for $\frac{5}{8}$ of the period. In an erase operation the drivers for the second electrode array have a sustainer applied in bulk after one quarter period measured from the leading edge of $V_H$ of the bulk sustainer and having a time duration of 9/16 of a period. The composite sustainer waveforms result in a voltage of one polarity and sufficient to sustain one polarity of discharge for $\frac{5}{8}$ of a period on a write function and, for an erase function, a voltage of the opposite polarity for $\frac{5}{8}$ of a period. It is to be understood that write and erase function can be performed from either polarization and for other proportions of the period of the composite sustainer hence the above characterization is merely exemplary of the lengthening of the time duration of polarization of the sustainer from which the charge manipulation by addressing is undertaken.

Addressing in the case of the first electrode array is by superimposing on the bulk sustainer a voltage pulse applied to the selected electrode. In the case of the second array the select signal is a transition to the reference voltage level during the portion of the period the sustainer composent voltage for that array is displaced from its reference level.

The logic control of the system controls all timing and signal application sequences for the source of the bulk sustainer and each addressing signal source.

BRIEF DESCRIPTION OF THE DRAWINGS

The above and additional object and features will be more fully appreciated from the following detailed description when read with reference to the accompanying drawings in which.

DETAILED DESCRIPTION OF A PREFERRED EMBODIMENT

Figure 1:
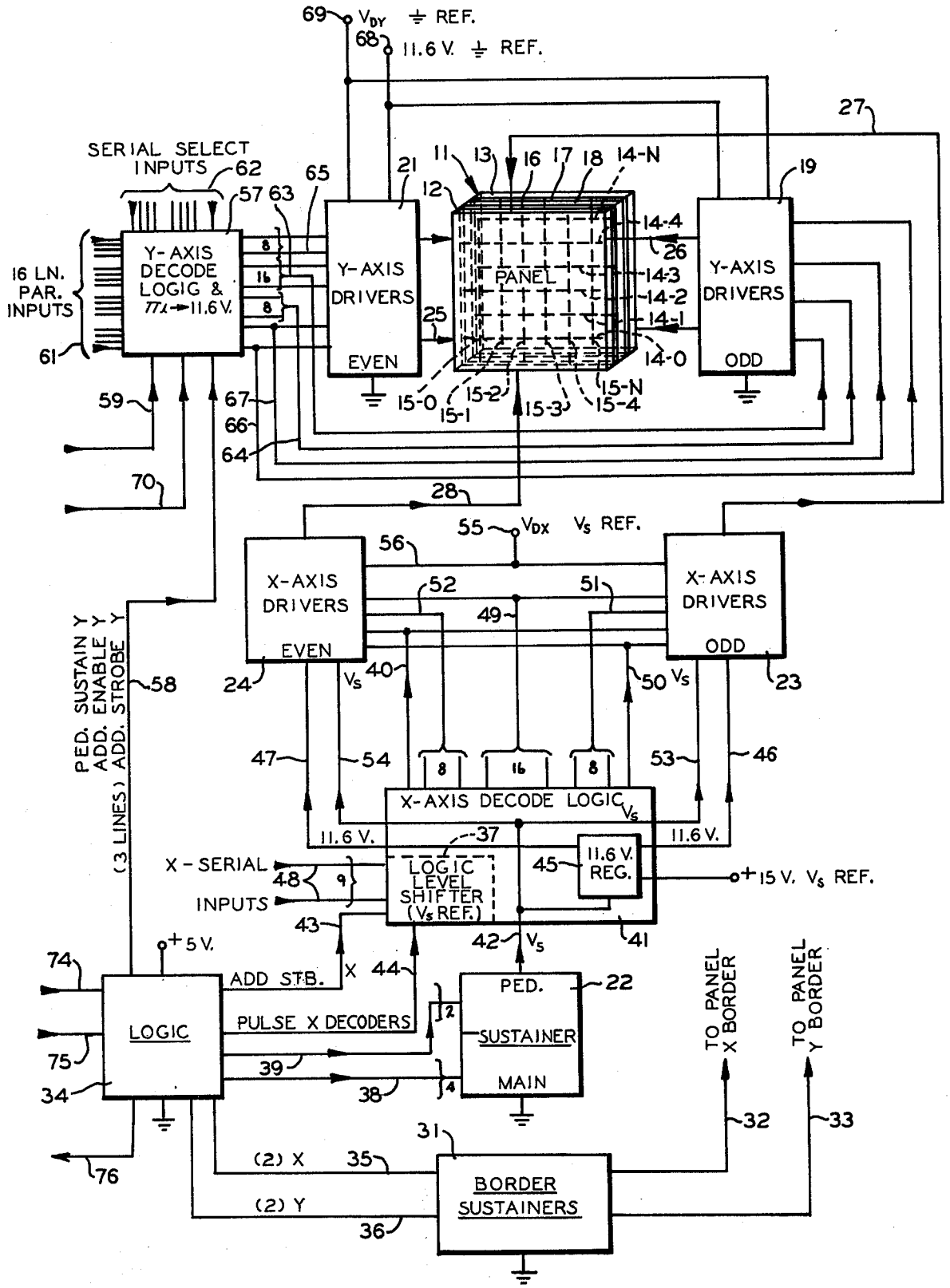
FIG. 1 is a block diagram of a system for operating a gaseous discharge display/memory panel according to this invention.

A block diagram of a system operating according to this invention to display characters or images as discharging sites on a gaseous discharge display panel 11 is shown in FIG. 1. Panel 11 is constituted by a pair of support plates 12 and 13 on which are placed row (Y) conductors 14 and column (X) conductors 15, the conductor arrays having dielectric coatings 16 and 17. The respective plates are joined in spaced apart relation by spacer sealant means 18 to form therebetween a thin gaseous discharge chamber, in which may be placed a suitable gaseous discharge medium such as the neon-argon mixture mentioned above. The individual conductors 14-0, 14-1 14-N in row conductor array 14 are driven by row conductor coincidence gates which can be integrated circuits represented by rectangles 19 and 21 for the odd and even electrode gates appearing on the right and left sides of the panel 11 respectively. The column conductors 15-0, 15-1 . . . 15-N in column conductor array 15 are driven by bulk sustainer circuitry 22 through column conductor coincidence gates 23 and 24 for the odd and even electrodes fed at the top and bottom of the panel respectively.

The panel 11 can be a five hundred twelve electrode by five hundred twelve electrode dot matrix device wherein the discharge sites are at the intersection of the projections of the electrodes through the thickness of the panel. Conventionally the even numbered row electrodes in the display designated 14-0, 14-2 . . . 14-510 are coupled to external circuitry on an extension of support plate 12 on the left through two hundred and fifty-six connector terminals (not shown) represented by leads 25 while the odd numbered row electrodes 14-1, 14-3 . . . 14-511 are connected as by leads 26. Similarly, 256 odd numbered column electrodes are fed by their conductors 27 at the top and the even numbered column electrodes are fed through leads 28 at the bottom. The display area defined by the arrays of electrodes 14 and 15 is supplied with discharge conditioning particles by border electrodes (not shown) which may be beyond the viewing area on each side of the display matrix.

The border electrodes are operated conventionally and are supplied the alternating wave forms necessary to initiate discharges in the border conditioning region of the panel and to maintain such discharges by border sustainers 31 having leads 32 to the X border conditioning electrodes and leads 33 to the Y border conditioning electrodes. The border sustainers are controlled by the system logic 34 through two leads 35 for the X axis by which are actuated in X border sustainer up signal and an X border sustaining down signal and two leads 36 for the Y axis up and down Y border sustainer signals.

The present invention utilizes separate bulk sustainer and individual electrode addressing circuits on only one array of electrodes, the column or X electrode array 15 in the example. A sustainer circuit 22 issues a bulk sustainer wave form which, as will be discussed, includes a high voltage level, $V_H$, a medium voltage level, $V_M$, and a low voltage level $V_L$, which is ground in the illustrated system. Main logic circuit 34 controls the sustainer circuit 22 according to the function to be performed by the system by means of four inputs, an X array up start signal, an X array up stop signal, an X array down start signal and an X array down stop signal on leads represented by line 38. Circuit 34 also controls the pedestal signal levels of the bulk sustainer issued from 22 by two inputs, an X pedestal start and an X pedestal stop on leads represented by line 39.

Since the X bulk sustainer voltage provides the reference voltage for the X axis drivers, a level shifter circuit 37 for then controlling logic signals is included in an X axis logic decoder 41 provided between the sustainer circuit 22 and the decode logic circuit 41. The sustainer signal is transmitted on lead 42 and is controlled by the system logic circuit 34 by a signal "address strobe the X axis" on lead 43 and a "pulse the X decoders" signal on lead 44. Logic level voltages are supplied from section 45 of the level shifter decoder board 41 and are passed on to the drivers 23 and 24 on lines 46 and 47.

Input signals for addressing the X axis are applied in binary form on 9 leads on the X-axis serial input leads 48 and are decoded to sixteen group enable signals represented as line 49 and eight electrode addresses within each group on line 51 for odd X axis drivers 23 and line 52 for even X-axis drivers 24. Odd and even strobe signals for the driver sections 23 and 24 are connected in parallel from logic decoder 41 on leads 40 and 50.

The sustainer signal $V_S$ is passed on lines 53 and 54 to the drivers and through their gates as the reference level for addressing pulses of a level derived at source 55 and imposed through lead 56. These driver voltages can be adjustable, as from forty to seventy volts and $V_{DX}$ can be set at 65 while $V_{DY}$ is set at fifty volts.

The arrangement of control for the Y axis is simplified by the absence of a bulk sustainer which permits the driver and decode logic to be referenced to ground. Main system logic 34 issues pedestal sustain signals for the Y array, address enable Y and address strobe Y to the Y axis decode circuits 57 on leads represented by line 58. The Y axis decode circuits are arranged for serial or parallel addressing as determined by signals from the user input (not shown) on line 59. The user input has access to the Y axis decode circuit through sixteen lines 61 of parallel inputs and nine lines of serial select inputs 62. Y axis decode logic circuit selects the Y axis driver group over sixteen lines 63 and the driver of the eight in each group which is to be enabled over line 64 for the odd groups and line 65 for the even group. Odd and even strobe signals for the Y groups of drivers are connected in parallel to the odd and even driver circuit groups on lines 66 and 67 to provide the 256 discrete selections from each group.

As in the case of the X axis drivers, the Y axis drivers have a logic level supply 68 and a pulse signal level supply $V_{DY}$69. While the X axis logic level is referenced to the pulsating $V_S$ voltage, the Y axis logic level is referenced to ground.

The system illustrated is arranged to present displays formed with origins in different areas of the panel 11. This feature is at the user's option and accordingly an origin select input 70 is provided to the Y decode logic 57.

Figure 2:
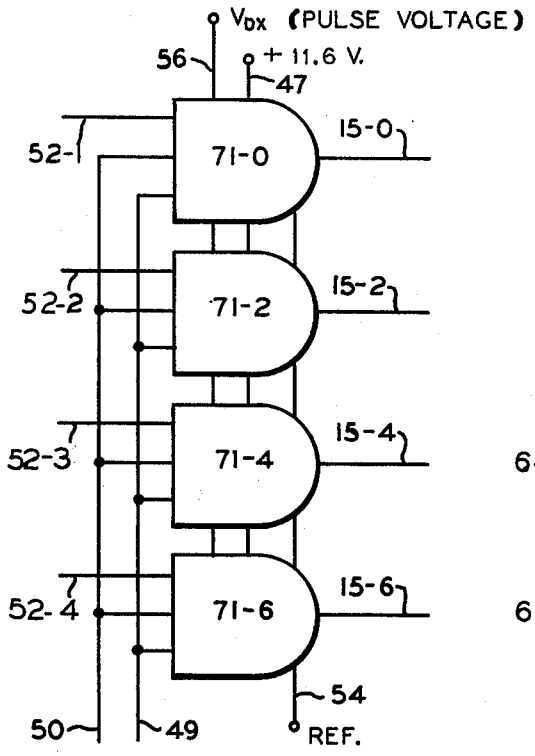
FIG. 2 is a logic diagram of a group of coincidence gates for electrodes of one array of a gaseous discharge display/memory panel as suitable for utilization in the system of FIG. 1.
Figure 3:
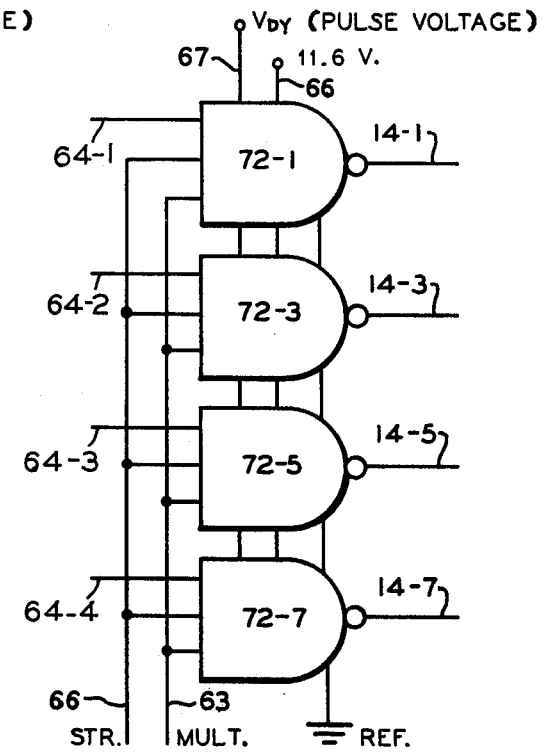
FIG. 3 is a logic diagram of a group of coincidence gates for electrodes of the second array of the panel of FIG. 1.

As best seen in FIGS. 2 and 3, the drivers 19, 21, 23 and 24 sink or source current and are AND gates 71 for the X drivers 23 and 24 and NAND gates 72 for the Y drivers 19 and 21. Advantageously, they can be bi-polar integrated circuits with each chip composed of quadruple 3-input gates in positive logic as high voltage and high current devices. All the data input terminals are buffered with emitter followers (not shown) which provide high input impedance and minimize leakage current. As shown for the ANDs 71-0 through 71-6 of even drivers for the first or odd group of the X array in FIG. 2, the data input terminals are the strobe signal passed from the logic circuit 34 through 43 and decoder 41 to lead 40 for odd groups of drivers in the odd and even X axis drivers 23 and 24 and lead 50 for the even groups of such drivers, the group selection signal on one of sixteen lines 49 from decode logic 41, the bulk sustainer reference level on 54, the logic signal level in 47 and the X driver pulse voltage level $V_{DX}$ on lead 56. Individual drivers of the enabled group are addressed on their selection leads 52-N from decode logic 41. All pulse voltage, logic voltage, strobe and group selection signals are referenced to the bulk sustainer from sustainer circuit 22 in this instance. The Y axis NAND gates for the first odd group of drivers are shown as 72-1 through 72-7 with corresponding signals referenced to ground in FIG. 3.

Figure 6:
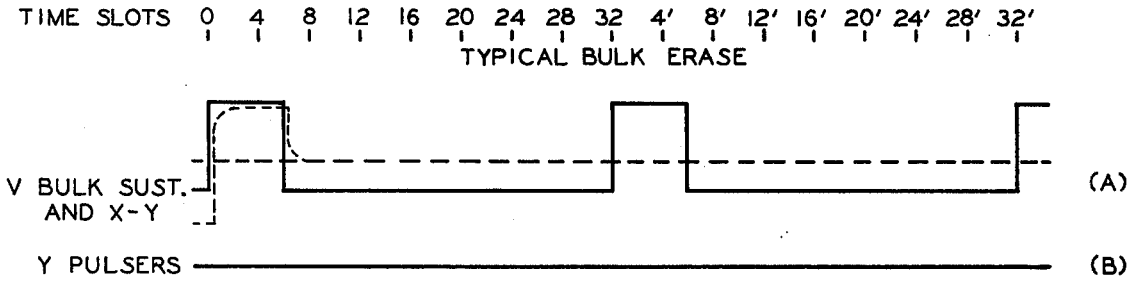
FIGS. 6 (A) and (B) are wave forms similar to those of FIG. 4 for a bulk erase function.
Figure 4:
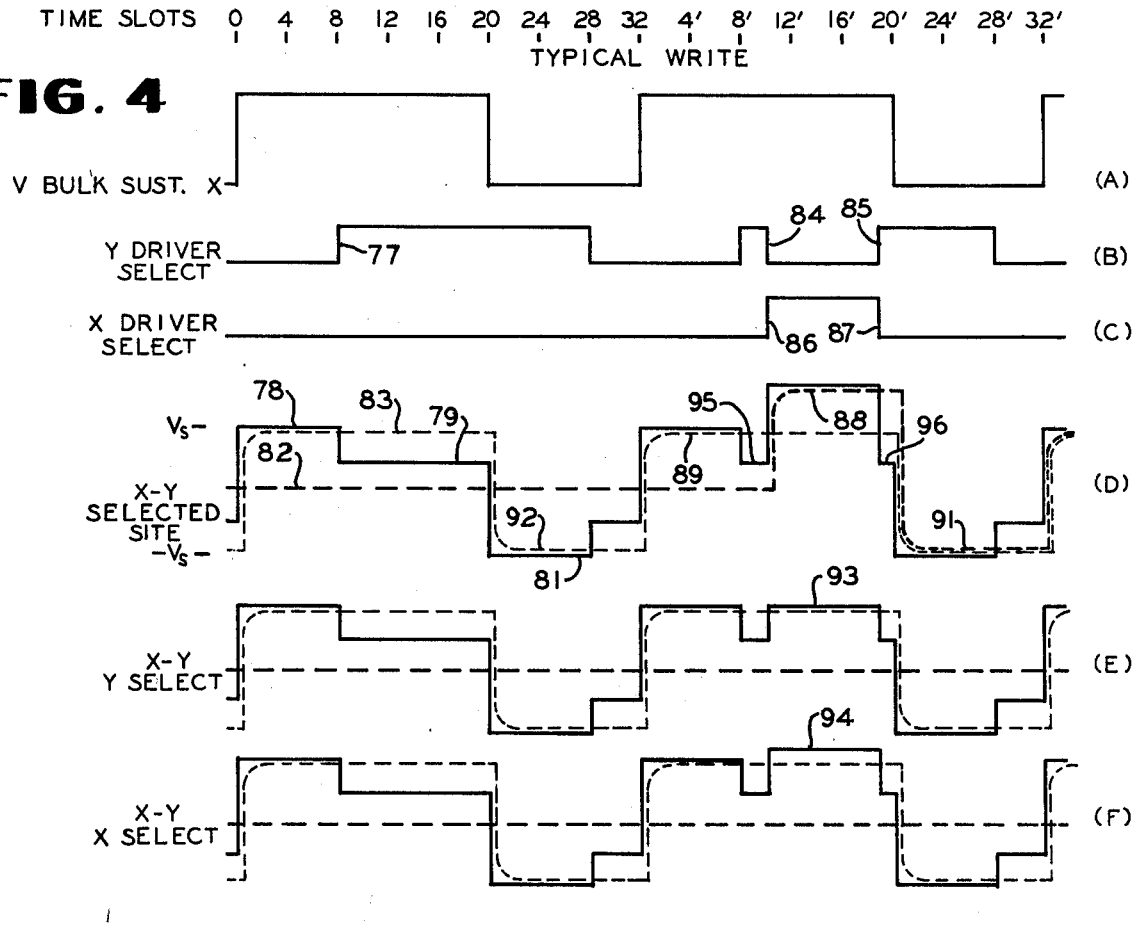
FIGS. 4 (A) through (F) are typical wave forms plotted as voltege vs. time for the components and composite wave form for a write function according to this invention.
Figure 5:
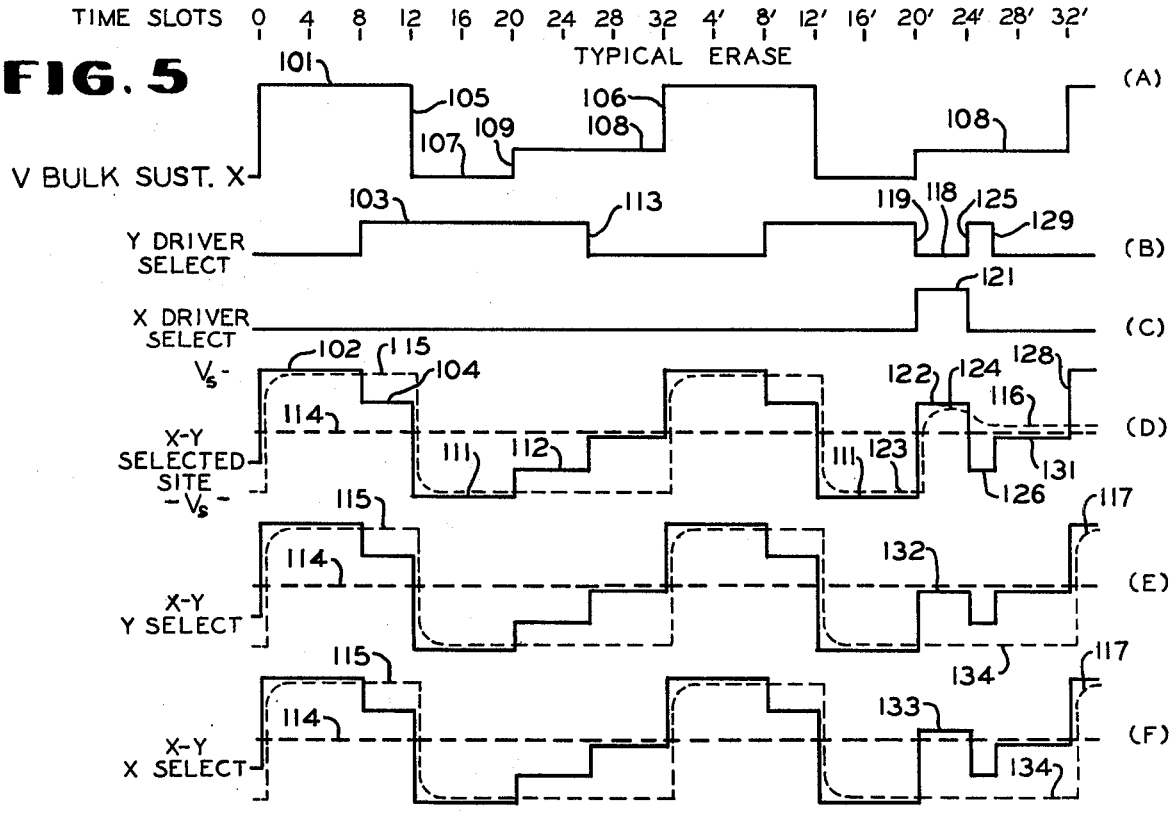
FIGS. 5 (A) through (F) are wave forms similar to those of FIG. 4 for an erase function.

In accordance with this invention, the system is operated to produce wave forms as shown in FIGS. 4, 5 and 6 wherein a bulk sustainer is applied to only one axis or electrode array, the X axis and electrodes 15-0 through 15-511 in the example. Serial addressing of electrodes is referenced to this bulk sustainer by drivers 23 and 25 which superimpose voltage pulses on the sustainer for selected electrodes. The drivers 19 and 21 for the other electrode array, the Y axis, perform a sustainer generating function limited to the driver pulse signal level and referenced to a fixed voltage, advantageously ground. With this reference level this axis is particularly adapted to either serial or parallel addressing without undue noise.

The asymmetry of the sustainer shifts the neutral voltage level of the wall voltage within the panel so that for a single axis bulk sustainer which has positive excursions of voltage relative to ground and lesser bulk operation of addressing drivers providing a sustaining function on the opposite axis, the neutral level is displaced relative to ground. In the discussion of the wave forms they will be treated as square waves which are at designated levels throughout the time slots of each cycle of applied signals. The logic circuitry 34 includes clocking means (not shown) which in the example will be assumed to define signal cycles of thirty-two time slots each of 625 nanoseconds duration to provide a signal period of 20 microseconds (50 Khz) for the display cycle period.

The logic circuit 34 responds to mode selection signals from the user interfacing (not shown) at lines 74 and 75 to operate in either a sustain mode, a selective write mode, a selective erase mode or a bulk erase mode. When a logic mode function is operating a busy flag inhibits further mode signals from the user by issuing a signal on flag line 76. For purposes of this disclosure the selective write mode, selective erase mode and bulk erase mode will be disclosed for site discharge state manipulation and it will be assumed that the sustainer form for either an erase or write function will be utilized as a sustainer between discharge state manipulations. In view of this assumption two signal cycles have been disclosed wherein the first cycle and its thirty two time slots are employed to illustrate the sustainer waveforms and the second signal cycle has its time slot designations primed and represents a discharge state manipulation of a selected site. It should be recognized that other sites in the panel will be subject to the sustainer illustrated in the first cycle except for those sites on which one partial select is imposed, as the sites along the X and Y electrodes of the selected site.

A typical write bulk sustainer applied from circuit 22 to the electrodes of the X array is shown in FIG. 4 (A) as a positive voltage for twenty time slots or $\frac{5}{8}$ of a period and a reference level voltage for twelve time slots or $\frac{3}{8}$ of a period. Cooperating with the bulk sustainer is a sustainer applied to a plurality of the electrodes of the Y array by the individual Y electrode drivers 72 over a period of twenty time slots offset eight behind the bulk sustainer as shown in FIG. 4 (B) at time 77. The resultant wave form applied across the panel is shown in FIG. 4 (D) derived as the difference between the signals on the two arrays or X minus Y. The resultant wave form is high for the first eight time slots ($\frac{1}{4}$ period) 78 defining the maximum positive excursion $V_S$, at an intermediate high or pedestal level 79 suitable for writing sites (transferring sites in an "off" state of discharge to an "on" state) for twelve time slots or ($\frac{3}{8}$ of a period), at a low level 81 defining the maximum negative, excursion, $-V_S$, for eight times slots ($\frac{1}{4}$ period) and at an intermediate low level for four times slots ($\frac{1}{8}$ of a period). In the example the high level bulk sustainer voltage is 140 volts above its reference level, the high Y driver is 50 volts above the reference level and thus the total transition of the composite wave form is 190 volts placing neutral 95 volts from the extremes as shown at trace 82 for sites in the "off" state. Trace 83 shows the wall charge voltage pattern for sites in the "on" state.

In order to write a site, partial select signals are imposed on the X and Y electrodes whose projection through the panel thickness define the site. In the case of the Y electrode it is addressed through its gate 72 by interrupting the sustainer component as at 84 of FIG. 4 (B) and concluding that interruption at 85. This effectively applies a partial select signal of the magnitude of the sustainer component supplied by drivers 72, namely 50 volts in the example. The X electrode receives a partial select from the driver 71 associated with it as shown at 86 and 87 of FIG. 4 (C), a 65 volt pulse in the same nine time slots as they partial select. As is shown in FIG. 4 (D) the wave form for the composite applied voltage at the selected site is a select signal of the sum of the partial selects, 115 volts, on a write pedistal 45 volts above the panel neutral voltage. This total of 160 volts above neutral applied across the site is sufficient to initiate a discharge so that the off cell wall voltage shifts from the neutral level at 82 to a value 88 near the select level as the wall charge on the dielectric accumulates and develops the counter voltage which ultimately terminates the discharge. This initial wall voltage 88 may be greater than the normal "on" site wall voltage 89. However, after a transition of the sustainer the wall voltage, it is limited to less than the sustainer as shown at 91 where it corresponds to that of an "on" site shown at 92.

The effect of the partial select signals is illustrated for a write function at FIG. 4 (E) for a Y partial select from wave form FIG. 4 (B) and for an X partial select at FIG. 4 (F) from wave form FIG. 4 (C). It will be noted there is a slight unbalance in partial selects which might tend to reduce write margins but has been found to be tolerable. Thus, partial select 93 appears as a continuation of the sustainer maximum on those sites along the Y electrode of the selected site. The partial select 94 is fifteen volts above the maximum sustainer at those sites along the X electrodes of the selected site; however, this deviation is within the operating margins of the panel and has been found to cause no adverse effects.

It will be observed from a comparison between the wave forms of a write and an erase function that the basic sustainer wave form defined by the bulk sustainer wave form and the Y driver wave form has a relatively long addressing interval and an abreviated interval of the polarity opposite the addressing interval. This is controlled by the logic circuit 34 as a signal represented by line 58 to the Y axis decode logic 57 while the bulk sustainer is controlled at 22 by signals on lines 38 and 39. In the case of a write mode, the long duration time interval of the write select signal enables a lower voltage to write all sites addressed. Stablization of the internal conditions of the panel dictates the provision of eight time slots following the major transistions of voltage. A guard band is provided on each side of a write select signal to enhance reliability of cell manipulations. Prior to a write select signal the guard band 95 of two time slots duration limits the charge transfer when a cell is written. An excess of charge transfer can result in a loss of control. A single time slot at the trailing guard band 96 facilitates switching between voltage extremes and also enhances charge transfer stability.

After a selected site has been written the sustainer can be maintained in its write mode of time slots 0 through 32 of FIG. 4 (D) beginning at 32', the zero instant of the next sustainer period. Other sites can be written from this sustainer mode or the panel can continue to be subjected to this mode until a new function is required, as a selected erase or a bulk erase.

A typical erase mode operation is shown in FIG. 5 with wave forms of its components and composite for the selected site and the partially selected sites on the coordinates of the selected site. A bulk sustainer erase wave form has a shortened non-erase portion of the sustainer of twelve time slots at 101 for the maximum positive excursion and in the composite for eight time slots at 102 by virtue of the Y drivers sustainer wave form excursion 103 such that there is a transition level 104. The remainder of the sustainer period, twenty time slots is employed for the erase manipulation. The bulk sustainer includes a low or reference level interval initiated by an "X down go" signal at instant 105 and terminated by an "X down stop" at signal 106 from logic circuit 34 on line 38 to sustainer circuit 22. The minimum bulk sustainer is maintained for eight time slots at 107. An erase pedestal 108 is instituted by an "X pedestal go" signal at 109 and terminated by an "X pedestal stop" at 106 dicated by logic circuit 34 on line 39. This pedestal can have a value of forty volts in the example. A step from composite sustainer minimum 111 is imposed by pedestal 108 at 112 for an erase pedestal of six time slots. Upon termination of the Y driver excursion 103 at 113, the composite sustainer makes a transition of fifty volts positive. In the erase mode this is five volts below the neutral level of the panel dictated by the half value between extremes 102 and 111 since it will be noted that the increases from ninty-five volts below neutral at 111 is a cumulative forty volts at time 109 and fifty volts at time 113.

An "off" site wall charge is represented in the composite X-Y erase wave forms for the selected site and its coordinates of FIGS. 5 (D), (E) and (F) by the dashed line 114. An erase select applied to an "off" site will have no discharge manipulative effect. An "on" site will exhibit regular transitions of wall charge as shown in time slots 0 through 32 for each of FIGS. 5 (D), (E) and (F) as at 115. This site, when selected, will have its wall charge brought to the neutral level and its "on" state terminated as at 116 by an erase select although its erase partial selects along the Y coordinate, FIG. 5 (E), and X coordinate, FIG. 5 (F) will not be so manipulated and will continue in the "on" state as at 117.

Considering the erase manipulation of the second illustrated sustainer signal cycle of FIG. 5, a partial select in the form of a fifty volt transition is imposed by the Y driver 72 for the Y electrode of the selected site at 118 beginning at 119 the twentieth time slot, coincident with the initiation of pedestal 108 on the bulk sustainer, and at the same time in the form of a sixty five volt transition imposed by the X driver 71 of the X electrode of the selected site at 121. These transitions in voltage levels algerbraically combine as a one hundred sixty five volt positive going pulse 122 from the maximum negative excursion of the composite sustainer at 111. Such a voltage imposes a sufficient level to initiate the discharge of the "on" site from a wall voltage at 123 to a level at or near the neutral wall voltage level of an "off" site at 114. In the illustration the wall voltage is shown as having a transition somewhat above the neutral level 114 to a level 124. Level 124 is limited by the magnitude of the "erase" discharge manipulation signal 122, which is fifty volts from neutral in the example, and by the time duration of that signal, four time slots. It is further reduced during the interval of charged particle activity at the site by a negative voltage transition which tends to interrupt the accumulation of wall charge or even reduce that accumulation as represented by the reduced charge level 116. In subsequent sustainer major transition of voltage that charge level and wall voltage will be brought to that of other "off" state sites and will be of the form shown at 114. The negative going transition voltage is provided at time 125 by Y driver 72 as it is returned to its sustainer level of fifty volts from ground and the time coincident return of X driver 71 to its reference value on the bulk sustainer by a drop of sixty-five volts. The composite transition 126 is sixty five volts below neutral in the example and is sustained for two time slots.

Erasing of a site is facilitated by providing time for discharge activity at the site to diminish after an erase manipulation of a discharge state and before the next major transition to a sustainer value of opposite polarity as at 128. Termination of the Y driver sustainer signal for the selected site at time 129 results in a fifty volt transition to 131 of the composite wave form at the selected site toward the polarity opposite that from which the erase manipulation was initiated; however, this is below the neutral level and the maximum value of the erase select signal.

The partial select signals on the sites along the coordinates of the selected site are insufficient to manipulate charge states on the cells. Those signals are respectively a ninty volt excursion 132 at time 119 on the Y axis sites and a one hundred and five volt excursion 133 on the X axis sites for the assumed values. These excursions are insufficient when augmented by the "on" state of any sites along the respective coordinates to initiate a discharge manipulation, hence, the wall charge voltage of "on" sites remains as illustrated at 134 in FIGS. 5 (E) and (F) and continues in subsequent cycles of the sustainer to follow the pattern of 115.

Typically, it is desirable to extend the life of a gaseous discharge display/memory panel by bulk erasing the panel periodically to cancel displays retained beyond the normal useful period. Such a cancellation can be scheduled every 30 minutes, as an example. FIG. 6 illustrates a typical bulk erase. In response to a bulk erase code at inputs 74 and 75 the logic calls for a main bulk sustainer pulse of suitable length such as six time slots as shown in FIG. 6 with no further voltage transition on the drivers. Thus the bulk sustainer on a bulk erase also represents the signal imposed across all active site in the panel and thus the X-Y wave form. The resultant pulse manipulates the discharge in all "on" state sites to the "off" state. Accordingly, no sustainer wave forms need be imposed until the next mode change signals are applied at 74 and 75. Depending upon the mode requested, a sustainer can be set up as shown in FIGS. 4 or 5 again based upon a ground reference voltage for one array of electrodes and a bulk sustainer for the second array while utilizing the addressing drives of the first array to provide both a sustainer component and addressing pulses to selected discharge sites.

In recapitulation, a method of manipulating to discharge condition, as by a writing of an "off" site an erasure of an "on" site, or a bulk erasure of a plurality of "on" sites, of a gas discharge information storage panel device, panel 11, is shown. The panel 11 has a first array of dielectrically insulated electrodes, the X array, electrodes 15, having dielectric coating 17, transversely oriented with respect to a second array of dielectically insulated electrodes, the Y array, electrodes 14, having dielectric coating 16, both of said arrays being proximate to a gaseous discharge medium, the intervening gas contained by sealant 18 and the opposed faces of dielectric coatings 16 and 17. The method steps comprise applying a periodically alternating pulse potential between electrodes of the first and second arrays through the gaseous discharge medium, as the composite wave forms X-Y of FIGS. 4 (D), 5 (D) and 6 (A). This alternating pulse potential is developed by applying a pulsating bulk sustainer voltage, FIGS. 4 (A), 5 (A) and 6 (A), to the first array, the X array, selectively applying first voltage pulses referenced to the bulk sustainer voltage to the electrodes of the first array, FIGS. 4 (C) and 5 (C) referenced to FIGS. 4 (A) and 5 (A) respectively, and selectively applying second voltage pulses referenced to a fixed voltage to the electrodes of the second array, FIGS. 4 (B) and 5 (B) referenced to system ground. The second voltage pulses are applied in timed relation to the bulk sustainer voltage as a function of the manipulation of charge states to be performed while contributing to the sustaining function of the panel so the wave forms of FIGS. 4 (B) and 5 (B) are algebraically combined to produce the cyclic transitions between maximum positive and negative voltage excursions from the neutral level in the composite wave forms for writing and erasing.

When a discharge manipulation of a selected site in the panel is undertaken, all sites are subjected to the composite panel voltage of the bulk sustainer voltage and the second pulsating voltage of the Y drivers. The select signals are positive going, hence a write function is performed on a positive excursion of the composite panel wave form while an erase function is performed on a negative excursion of the composite panel wave form. The select signal by the second or Y drivers is imposed by interrupting the pulsed level employed for sustaining to return the selected electrode of the addressed site to ground voltage while a time coincident pulse referenced from the bulk sustainer is imposed on the electrode of the addressed site in the opposite array by the first driver for that electrode. In writing an "off" site the positive or higher voltage excursion of the composite panel sustainer wave form occupies a preponderance of the sustainer signal period and the addressing pulse is timed to occur during that excursion. In erasing an "on" site the negative or lower voltage excursion of the composite panel sustainer wave form occupies the preponderance of the sustainer signal period and the addressing pulse is timed to occur during the lower voltage excursion. The erase addressing pulse is of relatively short duration and advantageously is followed by a negative going signal and an interval of substantial duration preceeding the next positive voltage excursion to the maximum.

Since the panel device sites rely on wall voltages developed from wall charges on the dielectric coating of the electrodes in the region of their crossover projections, and "off" site has a wall voltage termed a "neutral wall voltage" which is intermediate the extreme values of the composite wave form voltage excursions of the panel and usually centered between those excursions. Writing of a site, the initiation of a discharge at a site which is in the "off" state to develope a wall charge which will be sustained, is accomplished by raising the voltage applied across that site to an ionization discharge level by superimposing on or augmenting the bulk sustainer with the voltage of the first driver for the site and the transition to ground voltage of the second driver for the site. Erasing of a site, the initiation of a discharge at a site which is in the "on" state to develop a neutral wall voltage charge and thereby terminate the repetitive creation of "on" wall charges at the site, is accomplished by raising the voltage applied across the site to an ionizing discharge level by applying the voltage of the first driver for the site and the transition to ground voltage of the second driver of the site as positive going signals are superimposed on or augment the composite panel wave form while that wave form is at a low level and negative relative to neutral voltage. The erase select pulse limits the discharge so that it eliminates the "on" wall charge without developing an opposite polarity "on" wall charge.

In writing and erasing, addressing pedestals are developed on the composite panel wave form. These pedestals are of lesser absolute magnitude than the extreme excursions of the composite panel wave form and result from the overlap in time of the bulk sustainer voltage pulses and the second driver voltage pulses. A write address pulse is located on a time base on a write pedestal with guard bands on either side of the pulse by maintaining the pulse of the second driver for an addressed site for a time preceeding and a time following the write address pulse. An erase pedestal is formed by a pedestal voltage supplied by the bulk sustainer in overlapping time relation to the second voltage pulses. Thus two lower voltage levels are formed on the composite panel wave form with a low or maximum negative excursion preceeding an intermediate negative excursion. The erase pulse is imposed on the intermediate level and is time coincident with the initiation of that level. The values of the voltages of the first and second voltage pulses are each less than half the bulk sustainer voltage. However, when concurrently applied on the write pedestal, they exceed the level produced by the maximum bulk sustainer to initiate a discharge and when applied on an erase pedestal they initiate a discharge without developing an opposing wall charge.

In the system for the above operations the bulk sustainer is applied through the gating circuits or drivers for the first voltage pulses as a voltage reference level for those circuits, and is thereby applied to the electrodes of the first array. Logic circuits respond to input signals and a actuate decode circuits for the first and second drivers and the bulk sustainer circuit in proper time relationships. A logic level shifter is required for the first logic decode circuit to enable it to follow the bulk sustainer voltage. The drivers for the second array are referenced to ground hence no logic level shifter is necessary for the second driver decode circuits to interface then to the normally available logic level signals.

It is to be appreciated that the operating modes of this invention lend themselves to systems and display devices other than those illustrated. The illustrated wave forms are not presented as precise representations since the step functions may be less than true instantaneous transitions and the wall voltage characteristics may have inclined wave fronts and longer knee intervals, rather these wave forms are to illustrate the inventive concepts. Magnitudes of the voltages can vary according to the requirements of the devices illustrated. While write selects of longer time duration than erase selects are advantageous, the proportions of the signal period devoted to these functions can vary. Similarly, the brevity of erase selects can be varied. Pedestal signal levels and time periods can also be adjusted consistent with device requirements, addressing speed of the system and the sustainer frequency period. For example the logic can be arranged so that write and erase pedestals overlap in the time slots to maximize the total operating time interval for the function to be performed.

In view of the variants available it should be appreciated that the above disclosure is to be read as illustrative of the invention and not in a limiting sense.

What is claimed is:

1. A method of manipulating the discharge condition of a gas discharge information storage panel device having a first array of dielectrically insulated electrodes transversely oriented with respect to a second array of dielectrically insulated electrodes, both of said arrays being proximate to gaseous discharge medium which comprises applying a periodically alternating pulse potential between electrodes of the first and second arrays through the gaseous discharge medium by applying a pulsating bulk sustainer voltage to the first array; selectively applying first voltage pulses referenced to the bulk sustainer voltage to electrodes of the first array; and selectively applying second voltage pulses referenced to a fixed voltage to electrodes of the second array.

2. A method according to claim 1 wherein the fixed voltage level is ground.

3. A method according to claim 1 including applying said second voltage pulses in timed relation to the applied pulsating bulk sustainer voltage.

4. A method according to claim 1 including modulating the time duration width of the pulses of the pulsating bulk sustainer according to the discharge condition manipulation to be achieved.

5. A method according to claim 1 including modulating the amplitude of the pulsating bulk sustainer according to the discharge condition manipulation to be achieved.

6. A method according to claim 5 including modulating the time duration width of the pulses of the pulsating bulk sustainer according to the discharge condition manipulation to be achieved.

7. A method according to claim 4 including applying said second voltage pulses in timed relation to the applied pulsating bulk sustainer voltage.

8. A method according to claim 5 including applying said second voltage pulses in timed relation to the applied pulsating bulk sustainer voltage.

9. A method according to claim 1 wherein said second voltage pulses are applied simultaneously to a plurality of electrodes of said second array in a predetermined time relation to said bulk sustainer voltage and said selective application of said second voltage pulses defines a time interval at the fixed voltage coincident with said application of said first voltage pulses.

10. A method according to claim 9 wherein said selective application of pulses is applied to selected electrodes of said second voltage said second array.

11. A method according to claim 1 wherein proximate portions of electrodes of the first and second arrays each define a discharge site in the gaseous discharge medium and wherein the dielectric separating the proximate portions from the gaseous discharge medium assumes a given neutral wall voltage when the site is in a non-discharging state while the periodically alternating pulse potential is applied between electrodes of the first and second arrays, including the step of applying the voltage of the pulsating bulk sustainer which imposes on the first array the maximum voltage deviation of the bulk sustainer voltage from the neutral wall voltage for a preponderance of the period of the alternating pulse potential between electrodes of the first and second arrays to prepare the gas discharge panel device for initiation of discharge at a site which is in a non-discharging state.

12. A method according to claim 11 including the step of applying said first voltage pulse associated with the electrode of a site selected to initiate a discharge during the application of the maximum voltage by the bulk sustainer to augment the maximum voltage deviation of the bulk sustainer from the neutral wall voltage level.

13. A method according to claim 11 including the step of applying the second pulse voltage in overlapping time relationship with the terminal portion of the application of the maximum voltage deviation of the bulk sustainer.

14. A method according to claim 12 including the step of applying the second pulse voltage in overlapping time relationship with the application of the first voltage pulse and beyond the terminal portion of the maximum voltage deviation of the bulk sustainer.

15. A method according to claim 13 wherein the second voltage pulse is applied over a period from time preceeding to a time following application of the first voltage pulse whereby guard bands limit excess charge transfer at sites at which a discharge occurs.

16. A method according to claim 13 including the step of applying a voltage transition toward the reference level as said second voltage pulse associated with the electrode of a site selected to initiate a discharge in overlapping time relation with the application of the first voltage pulse associated with the electrode of the site to augment the maximum deviation of the bulk sustainer from the neutral wall voltage level.

17. A method according to claim 16 wherein the initiating of the application of the second voltage pulse is coincident with the initiating of the application of the first voltage pulse.

18. A method according to claim 16 wherein the step of applying the second voltage pulse is coincident in time with and of the same duration as the step of applying the first voltage pulse.

19. A method according to claim 1 wherein proximate portions of electrodes of the first and second arrays each define a discharge site in the gaseous discharge medium and wherein the dielectric separating the proximate portions from the gaseous discharge medium assumes a given neutral wall voltage when the site is in a non discharging state while the periodically alternating pulse potential is applied between electrodes of the first and second arrays, including the step of applying the voltage of the pulsating bulk sustainer which imposes on the first array lower voltages which are less than the maximum voltage deviation of the bulk sustainer from the neutral wall voltage for a preponderance of the period of the alternating pulse potential between electrodes of the first and second arrays to condition the device for termination of a discharge at a site which is in a discharging state.

20. A method according to claim 19 wherein said lower voltages include a low voltage for a first portion of the preponderance of the period and a voltage intermediate the low voltage and the maximum voltage for a terminal portion of the preponderance of the period.

21. A method according to claim 20 wherein the first portion is of sufficient time duration to enable the wall charge of sites in a discharging state to stabilize in an "on" state and wherein the second portion is of sufficient time duration to enable the wall charge of a site discharged from an "on" state to an "off" state to stabilize near the neutral wall voltage level.

22. A method according to claim 19 including the step of applying the second voltage pulse in overlapping time relationship with an initial portion of the application of the lower voltages.

23. A method according to claim 20 including the step of applying the second voltage pulse in overlapping time relationship with an initial portion of the application of the lower voltages including the first portion of low voltage application and the initial part of the terminal portion of intermediate voltage applications.

24. A method according to claim 19 including the step of applying the first voltage pulse associated with the electrode of a site which is in an "on" state of discharge during application of the lower voltages by the bulk sustainer to impose a voltage sufficient to initiate a discharge to an "off" state of discharge at the selected site.

25. A method according to claim 20 including the step of applying the first voltage pulse associated with the electrode of a site which is in an "on" state of discharge during application of the intermediate voltage by the bulk sustainer to impose a voltage sufficient to initiate a discharge to an "off" state of discharge at the selected site.

26. A method according to claim 20 including the step of applying a voltage transition toward the reference level as the second voltage pulse associated with the electrode of a site which is in an "on" state of discharge during application of the lower voltage by the bulk sustainer to impose a voltage sufficient to initiate a discharge to an "off" state of discharge at the selected site.

27. A method according to claim 21 including the step of applying a voltage transition toward the reference level as the second voltage pulse associated with the electrode of a site which is in an "on" state of discharge during application of the intermediate voltage by the bulk sustainer to impose a voltage sufficent to initiate a discharge to an "off" state of discharge at the selected site.

28. A method according to claim 24 including the steps of applying the second voltage pulses in overlapping time relationship with an initial portion of the application of the lower voltages and in overlapping time relationship with the selected first pulser, and causing a transition toward the reference level of the second voltage applied to the electrode of a site which is in an "on" state of discharge during application of the first voltage pulse to define an erase interval for the site.

29. A method according to claim 28 wherein the first voltage pulse is applied, and the second voltage pulse is maintained at the reference level for an erase interval of a time duration which is short relative to the time duration interval of lower voltage applied by said bulk sustainer.

30. A method according to claim 29 including the step of applying the bulk sustainer to impose on the first array the maximum voltage deviation of the bulk sustainer voltage from the neutral wall voltage at a time spaced from the termination of the erase interval sufficiently to reduce the discharge activity at the selected site prior to the imposition of the maximum voltage.

31. A method according to claim 1 wherein said pulsating bulk sustainer voltage has a major voltage excursion from a reference level at least twice the voltage of each of the first and second voltage pulse excursions from respective reference levels.

32. A method according to claim 31 wherein the first voltage pulse excursion is greater than said second voltage pulse excursion.

33. A method according to claim 31 wherein said pulsating bulk sustainer has a minor voltage excursion from a reference level which is less than each of the first and second voltage pulse excursion from respecitve reference levels.

34. A method according to claim 1 wherein the step of selectively applying second voltage pulses includes a transition of voltage toward the fixed voltage in time coincidence with the step of selectively applying first voltage pulses.

35. A method according to claim 34 wherein the fixed voltage level is ground.

36. A system for manipulating the discharge condition of a gas discharge information storage panel device having a first array of dielectrically insulated electrodes transversily oriented with respect to a second array of dielectrically insulated electrodes, both of said arrays being proximate to a gaseous discharge medium which comprises a source of a periodically pulsating bulk sustainer voltage; means for applying said bulk sustainer voltage to said first array of electrodes; first drivers for first select pulse voltages referenced to said bulk sustainer voltage and coupled to each of said first electrodes, first selective actuating means for selectively actuating said first drivers to apply said first pulse voltages to selected electrodes of said first array; second drivers for pulse voltages referenced to a fixed voltage and coupled to each of said electrodes of said second array; and second selective actuating means for selectively actuating said second drivers.

37. A system according to claim 36 wherein said fixed votage is ground and said means for selectively actuating said second drivers is referenced to ground.

38. A system according to claim 36 including means to define a plurality of types of discharge condition manipulations; logic circuitry to selectively control the means for applying said bulk sustainer to apply voltage excursions of said bulk sustainer voltage on a time duration basis as a function of the type of discharge condition manipulation defined by said defining means; said logic circuitry including means to control said selectively actuating means for said first drivers and said selectively actuating means for said second drivers.

39. A system according to claim 36 including means to actuate said second drivers to impose a voltage excursion from said fixed voltage on a plurality of said electrodes of said second array; and wherein said second selective actuating means for said second drivers cause a voltage excursion toward said fixed voltage on a selected electrode of said plurality in coincidence with the selective actuation of by said first selective actuating means of a first driver.

* * * * *

Notice of Adverse Decision in Interference

In Interference No. 100,674, involving Patent No. 4,101,810, J. D. Schermerhorn and J. W. V. Miller, SYSTEM FOR AND METHOD OF OPERATING GAS DISCHARGE DISPLAY AND MEMORY, final judgment adverse to the patentees was rendered Aug. 29, 1984, as to claims 1–10, 19, 20, 22, 24–26 and 34–39.

[*Official Gazette January 29, 1985.*]